US007298986B2

(12) United States Patent
Lee

(10) Patent No.: US 7,298,986 B2
(45) Date of Patent: Nov. 20, 2007

(54) IMAGE FORMING APPARATUS HAVING A MOVABLE OPERATION PANEL

(75) Inventor: Ho-il Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

(21) Appl. No.: 11/102,822

(22) Filed: Apr. 11, 2005

(65) Prior Publication Data

US 2005/0226647 A1 Oct. 13, 2005

(30) Foreign Application Priority Data

Apr. 10, 2004 (KR) ..... 10-2004-0024739

(51) Int. Cl.
*G03G 15/00* (2006.01)

(52) U.S. Cl. ..... 399/81

(58) Field of Classification Search ..... 399/81, 399/107

See application file for complete search history.

(56) References Cited

U.S. PATENT DOCUMENTS

2002/0191980 A1* 12/2002 Kudo ..... 399/81
2003/0039481 A1* 2/2003 Suzuki ..... 399/81

FOREIGN PATENT DOCUMENTS

JP 63-002033 1/1988
JP 63-030877 2/1988
JP 4-131858 5/1992
JP 09-046053 2/1997
JP 09-197748 7/1997
JP 2000-151654 5/2000
JP 2001-242673 9/2001
JP 2002-214535 7/2002
JP 2003101706 A * 4/2003
JP 2003345086 A * 12/2003
JP 2004032280 A * 1/2004
JP 2004148567 A * 5/2004
JP 2004191826 A * 7/2004
JP 2004195710 A * 7/2004
JP 2004198475 A * 7/2004
JP 2005010293 A * 1/2005
JP 2005084086 A * 3/2005
KR 1984-0000007 1/1984
KR 1999-010919 3/1999

OTHER PUBLICATIONS

Translation of Sonobe et al. (JP2001-242673a).*

* cited by examiner

*Primary Examiner*—Quana Grainger
(74) *Attorney, Agent, or Firm*—Stanzione & Kim, LLP

(57) ABSTRACT

An image forming apparatus includes a housing, an operation panel movably installed at the housing via a rotary shaft and having multiple buttons provided thereon, and a position adjustment unit to move the operation panel at a predetermined angle with respect to the housing and to maintain the operation panel at the predetermined angle.

30 Claims, 6 Drawing Sheets

IMAGE FORMING APPARATUS HAVING A MOVABLE OPERATION PANEL

CROSS-REFERENCE TO RELATED APPLICATIONS

This application claims priority from Korean Patent Application No. 2004-24739, filed on Apr. 10, 2004, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus in which an operation panel can freely move within a predetermined angle range with respect to a housing.

2. Description of the Related Art

Generally, an image forming apparatus, such as a printer and a copying machine, outputs visible images onto paper in response to image signals.

A conventional image forming apparatus includes an operation panel provided with several buttons to operate a developing unit for image development and the like.

The operation panel is disposed on an upper side of a main body of the conventional image forming apparatus. In a case where the conventional image forming apparatus includes a large capacity main body or is used as a multipurpose office automation device, users of the conventional image forming apparatus must stand to operate the buttons.

This may be unfavorable to handicapped users, like children who are generally short, or disabled persons who cannot stand.

Even in the case of average users, a sitting position may be disadvantageous in operating the conventional image forming apparatus.

Therefore, user-friendly technology to operate panel buttons is required in order to allow both disabled users and average users to operate the operation panel in a sitting position.

SUMMARY OF THE INVENTION

The present general inventive concept provides an image forming apparatus including an improved operation panel that can freely move within a predetermined angle range with respect to a housing.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an image forming apparatus including a housing, an operation panel movably installed at the housing via a rotary shaft and having multiple buttons provided thereon, and a position adjustment unit to move the operation panel within a predetermined angle range with respect to the housing and to maintain the operation panel at a predetermined angle.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
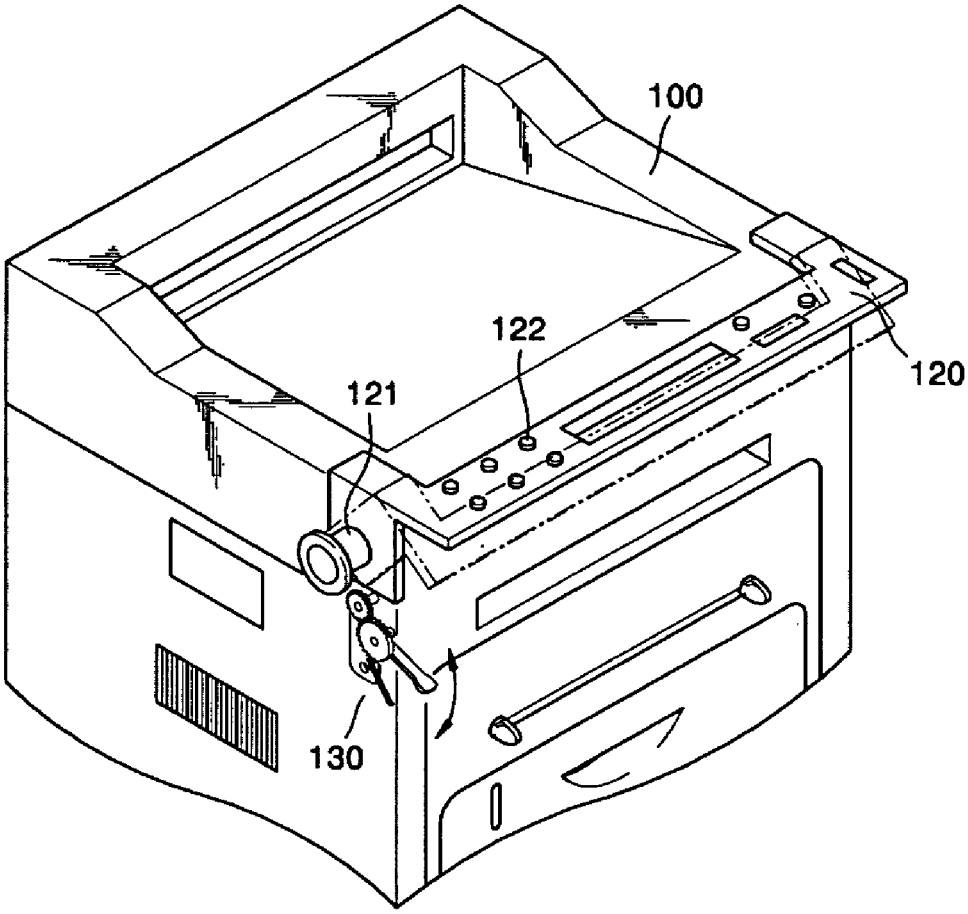
FIG. 1 is a perspective view illustrating an image forming apparatus including a position adjustment unit according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
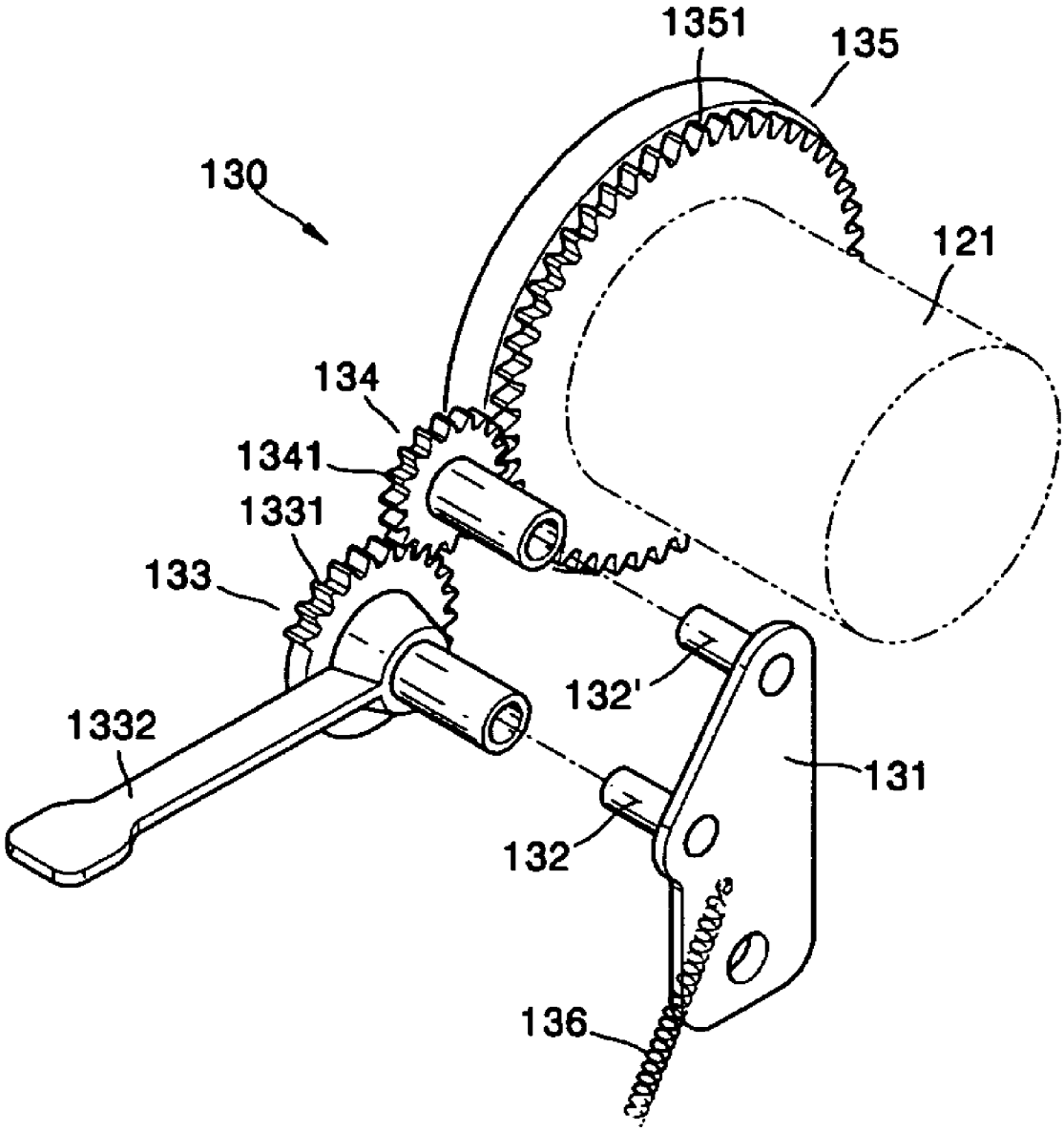
FIG. 2 is an exploded perspective view illustrating the position adjustment unit of FIG. 1.
Figure 3:
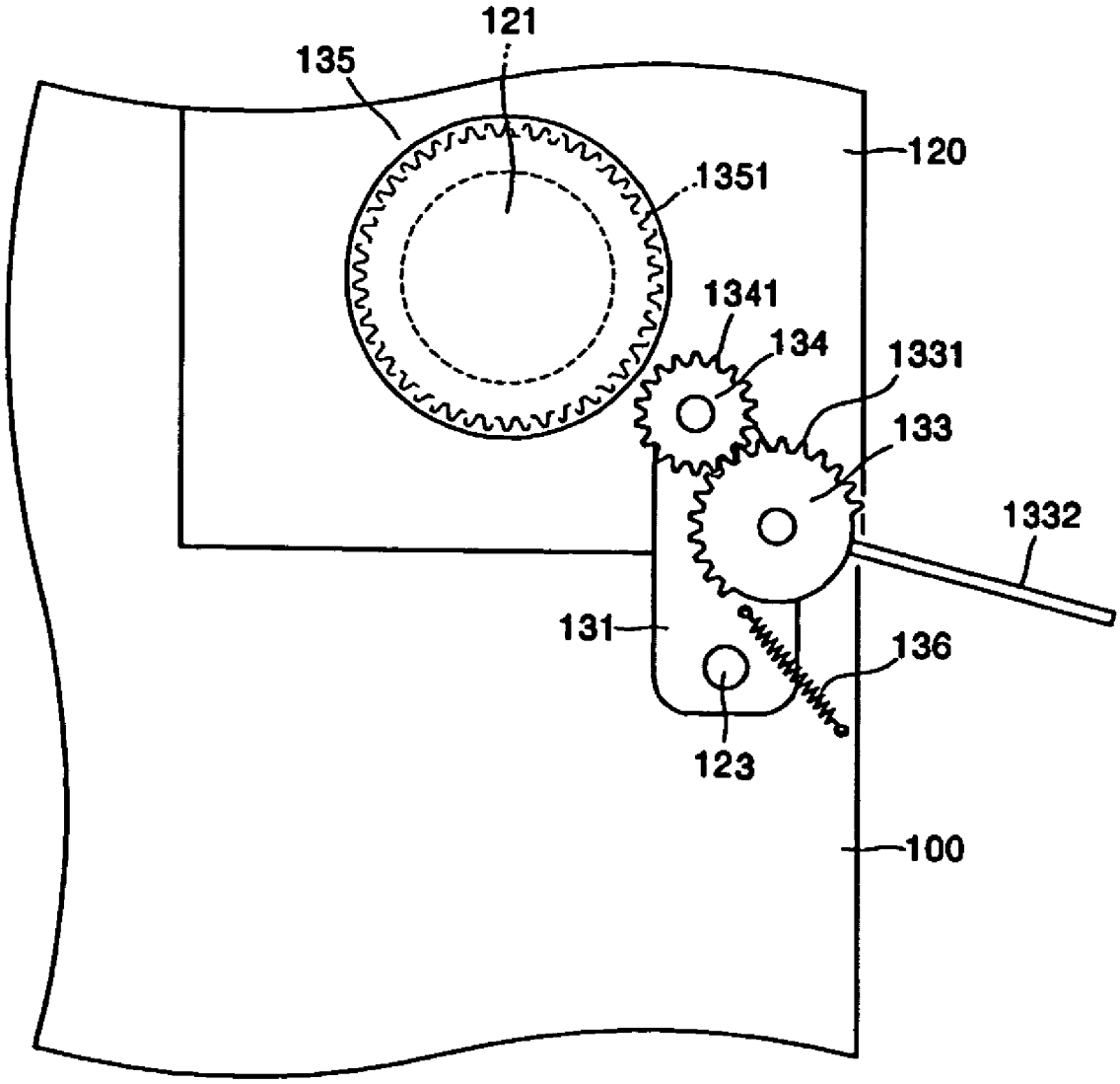
FIGS. 3 and 4 are views illustrating an operation of the position adjustment unit of FIG. 1.
Figure 4:
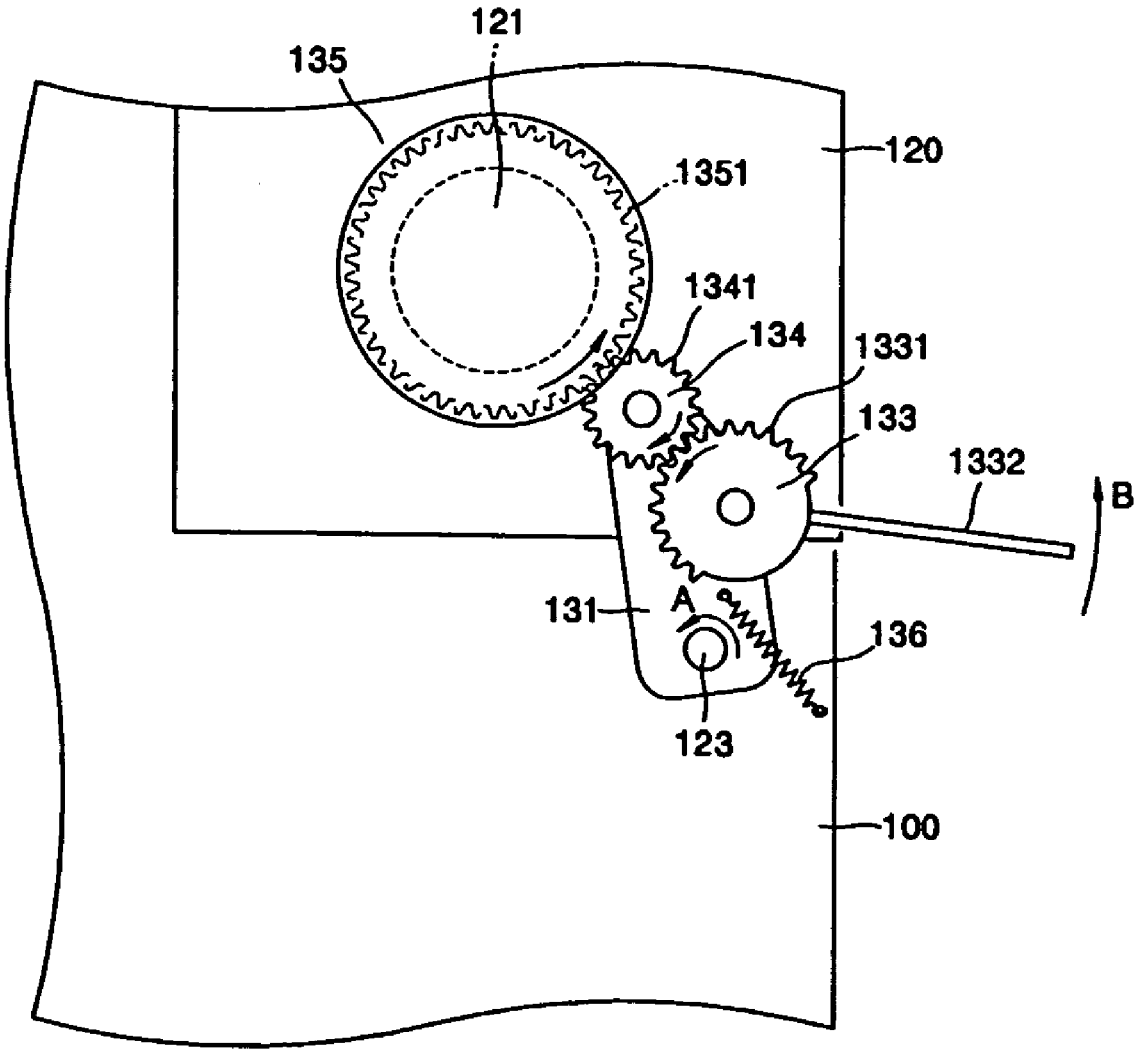

FIG. 1 is a perspective view illustrating an image forming apparatus including a position adjustment unit according to an embodiment of the present general inventive concept, FIG. 2 is an exploded perspective view illustrating the position adjustment unit of FIG. 1, and FIGS. 3 and 4 are views illustrating an operation of the position adjustment unit of FIG. 1.

Referring to FIG. 1, the image forming apparatus includes a housing 100, an operation panel 120 installed at an upper side of the housing 100 to move upward and downward via a rotary shaft 121 connected thereto and having operation buttons 122 provided thereon to operate an image forming unit (not shown) to form an image and other parts provided in the housing 100, and a position adjustment unit 130 to maintain the operation panel 120 at a predetermined angle with respect to the housing 100.

Referring to FIG. 2, the position adjustment unit 130 includes a bracket 131, a swing gear 133, an interlocking gear 134, and an angle adjusting plate 135.

The bracket 131 is rotatably installed at a bracket shaft (123, see FIG. 3) attached to the housing 100 and is provided with first and second shafts 132 and 132' at which the swing gear 133 and the interlocking gear 134 are rotatably mounted, respectively.

The bracket 131 is connected to an elastic part 136. The elastic part 136 has an end fixed to the housing 100 and causes the bracket 131 rotated about the bracket shaft 123 to return to an original position.

The swing gear 133 is rotatably mounted on the first shaft 132. Teeth 1331 are formed along a predetermined length of an outer periphery of the swing gear 133 and a lever 1332 extends from the swing gear 133.

The interlocking gear 134 is rotatably mounted on the second shaft 132'. Teeth 1341 are formed on an outer periphery of the interlocking gear 134 and engage with the teeth 1331 of the swing gear 133.

The angle adjusting plate 135 is installed at the rotary shaft 121 and has teeth 1351 on an outer periphery thereof.

As illustrated in FIG. 2, the angle adjusting plate 135 is provided at an end of the rotary shaft 121. Alternatively, teeth may be formed on an outer periphery of the rotary shaft 121.

Referring to FIG. 3, the bracket 131 is elastically biased away from the angle adjusting plate 135 by an elasticity of the elastic part 136. Therefore, the teeth 1341 of the interlocking gear 134 can be separated from the teeth 1351 of the angle adjusting plate 135.

Referring to FIG. 4, when a user presses the lever 1332 toward the angle adjusting plate 135, the bracket 131 approaches the angle adjusting plate 135 while rotating in a counter-clockwise direction (A) about the bracket shaft 123 and the teeth 1341 of the interlocking gear 134 engage with the teeth 1351 of the angle adjusting plate 135.

In this state, to rotate the rotary shaft 121 and adjust the operation panel 120, the user can move the lever 1332 in an arrow direction (B) to rotate the swing gear 133 in a counter-clockwise direction. The teeth 1331 of the swing gear 133 engage the teeth 1341 of the interlocking gear 134 to rotate the interlocking gear 134 in a clockwise direction. The teeth of the interlocking gear 1341 engage the teeth 1351 of the angle adjusting plate 135 to rotate the angle adjusting plate 135 and the rotary shaft 121 in a counter clockwise direction. When the user stops moving the lever 1332, the bracket 131 returns to an original position, in which the teeth 1341 of the interlocking gear 134 are separated from the teeth 1351 of the angle adjusting plate 135, by the elasticity of the elastic part 136.

The rotation of the rotary shaft 121, as described above, allows the operation panel 120 to be maintained at a predetermined angle with respect to the housing 100.

Meanwhile, the user can move the lever 1332 in an opposite direction to the direction B to rotate the rotary shaft 121 in a clockwise direction to adjust the angle of the operation panel 120 with respect to the housing 100.

Figure 5:
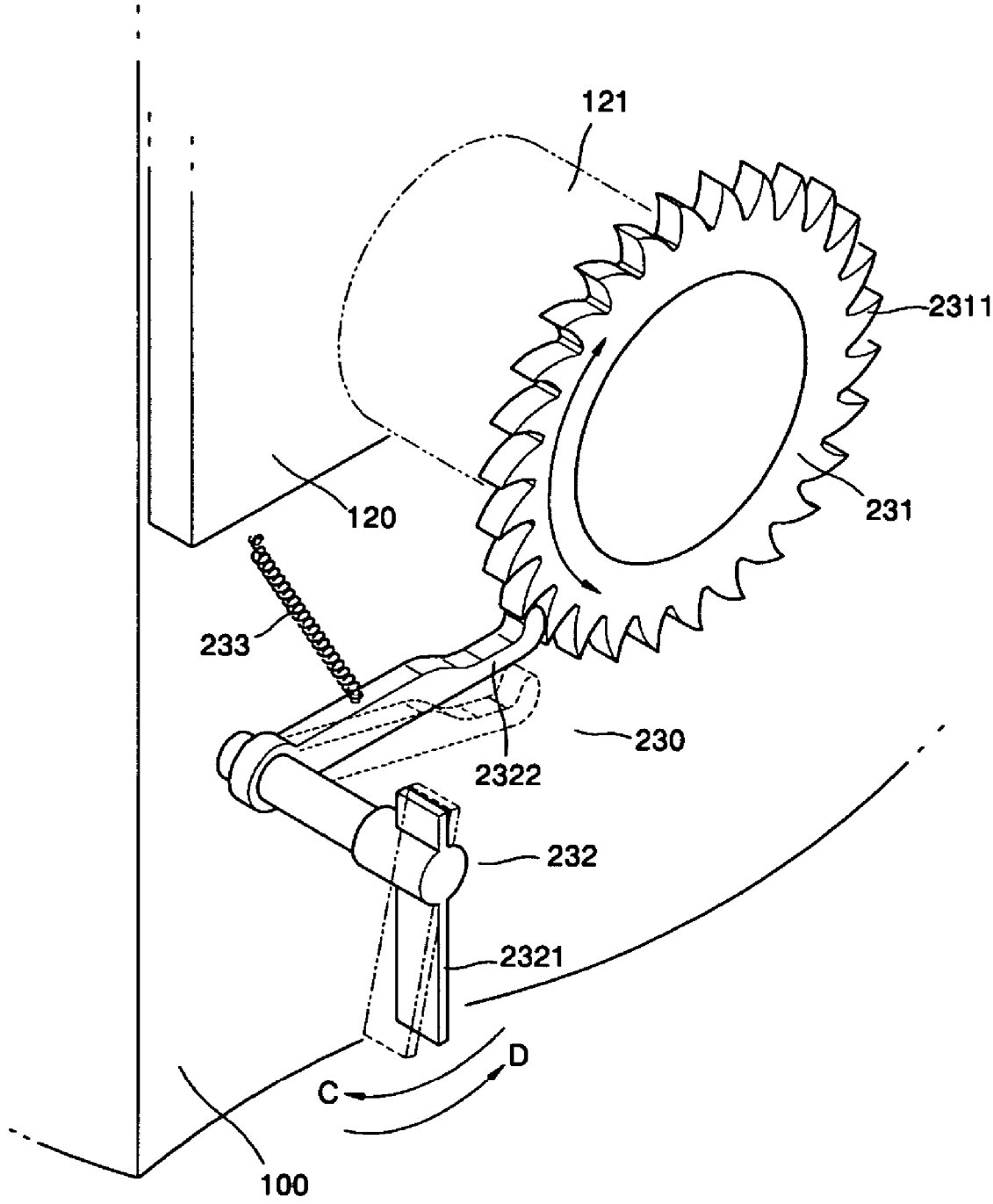
FIG. 5 is a perspective view illustrating a position adjustment unit according to another embodiment of the present general inventive concept.

FIG. 5 is a perspective view illustrating a position adjustment unit 230 according to another embodiment of the present general inventive concept. The position adjustment unit 230 includes an angle adjusting plate 231 and an operator 232.

The angle adjusting plate 231 is fixed to an end of the rotary shaft 121 and teeth 2311 are formed on an outer periphery of the angle adjusting plate 231.

The operator 232 is rotatably installed at the housing 100. The operator 232 includes an operation lever 2321 at an end thereof and a fixing portion 2322 at another end thereof. The fixing portion 2322 engages with the teeth 2311 of the angle adjusting plate 231 so that the angle adjusting plate 231 cannot be rotated.

The fixing portion 2322 is connected to an elastic part 233, an end of which is fixed at the housing 100, and is elastically biased upward by the elastic part 233. Therefore, the fixing portion 2322 can prevent the angle adjusting plate 231 from rotating.

As illustrated in FIG. 5, a tensile coil spring can be used as the elastic part 233. Alternatively, the operator 232 may be formed as a twisted spring.

An operation of the position adjustment unit 230 of FIG. 5 will now be described.

When the operation lever 2321 moves in a direction C, the fixing portion 2322 moves downward as shown by a dotted line. In this state, engagement between the fixing portion 2322 and the teeth 2311 of the angle adjustment part 231 is removed and the rotary shaft 121 can rotate freely. Therefore, a user can rotate the rotary shaft 121 to adjust the operation panel (see 120 of FIG. 1) by a desired angle with respect to the housing (see 100 of FIG. 1).

When the user releases the operation lever 2321 after the operation panel 120 is adjusted to the desired angle with respect to the housing 100 as described above, the lever 2321 moves in a direction D by an elasticity of the elastic part 233, and the fixing portion 2322 is positioned as shown by a solid line. Therefore, the fixing portion 2322 engages with the teeth 2311 of the angle adjusting plate 231 so that the angle adjusting plate 231 is maintained at the adjusted angle.

Figure 6:
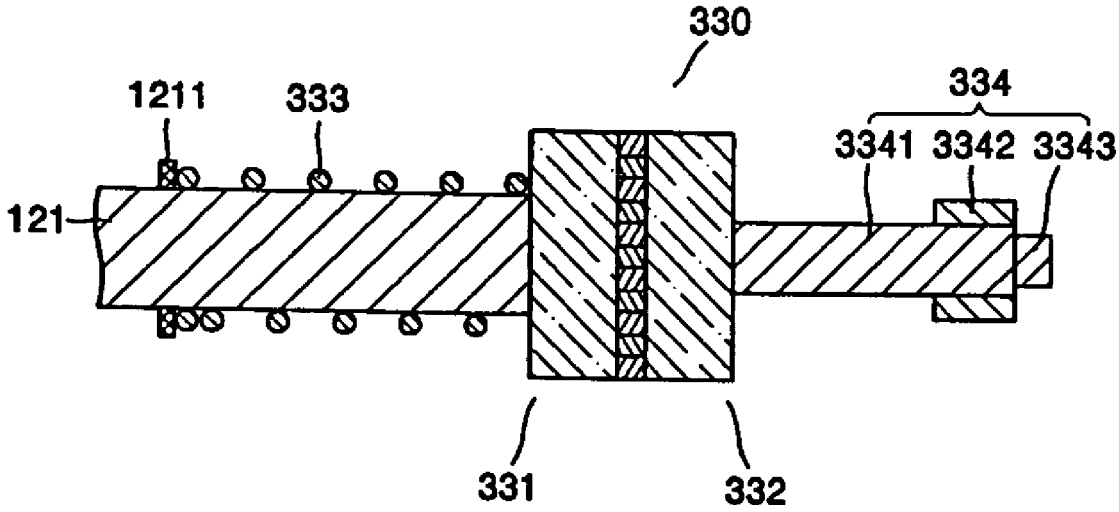
FIG. 6 is a sectional view illustrating a position adjustment unit according to still another embodiment of the present general inventive concept.
Figure 7:
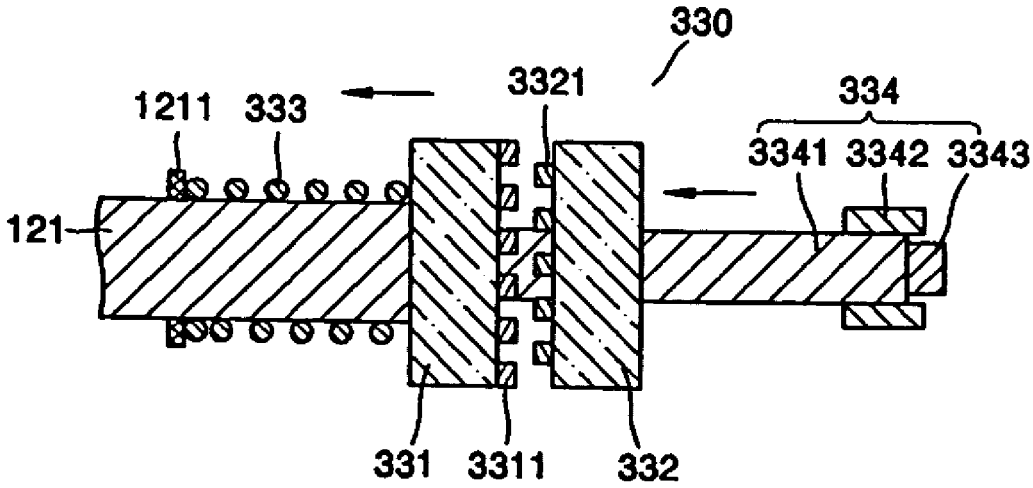
FIG. 7 is a sectional view illustrating an operation of the position adjustment unit of FIG. 6.

FIG. 6 is a sectional view illustrating a position adjustment unit according to still another embodiment of the present general inventive concept, and FIG. 7 is a sectional view illustrating an operation of the position adjustment unit of FIG. 6.

Referring to FIGS. 6 and 7, the position adjustment unit 330 includes a first coupling member 331, a second coupling member 332, and a release member 334.

The first coupling member 331 is slidingly installed along an axis of a rotary shaft 121. The first coupling member 331 is elastically biased toward the second coupling member 332 by an elastic part 333 supported by a blocking portion 1211 provided at the rotary shaft 121. A surface of the first coupling member 331 opposite to the second coupling member 332 is formed with multiple first coupling teeth 3311 that are separated from each other by a predetermined distance.

The second coupling member 332 is fixed at a housing (see 100 of FIG. 1), and a surface of the second coupling member 332 opposite to the first coupling member 331 is formed with multiple second coupling teeth 3321 separated from each other by a predetermined distance so that the second coupling teeth 3321 can engage with the first coupling teeth 3311.

The release member 334 includes a support member 3342 fixed at the housing, a release shaft 3341, an end of which is slidingly supported by the support member 3342 and another end of which slidingly passes through the second coupling member 332, and a button 3343 protruding from the end of the release shaft 3341 and slidingly supported by the support member 3342.

When a user pushes the button 3343, the release shaft 3341 connected to the button 3343 slides in an arrow direction through the second coupling member 332 to contact the first coupling member 331 so that the first coupling member 331 is separated from the second coupling member 332. At this time, the first coupling member 331 slides along the rotary shaft 121 in an arrow direction and presses the elastic part 333. In this state, the user adjusts a desired angle of an operation panel (see 120 of FIG. 1) with respect to the housing 100.

After the operation panel 120 is adjusted by the desired angle with respect to the housing 100, when a force applied to the button 3343 is removed, the first coupling member 331 slides in an opposite direction to the arrow direction by an elasticity of the elastic part 333, and the first coupling teeth 3311 of the first coupling member 331 engage with the second coupling teeth 3321 of the second coupling member 332. At this time, the operation panel 120 is maintained at the desired angle with respect to the housing 100.

Here, a sliding length of the release shaft 3341 can be longer than a distance required to separate the first coupling teeth 3311 of the first coupling member 331 and the second coupling teeth 3321 of the second coupling member 332 when the button 3343 is pushed.

As describe above, an image forming apparatus according to various embodiments of the present general inventive concept allows a user to easily adjust a desired angle position of an operation panel with respect to a housing, thereby enhancing operational convenience.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a housing;

an operation panel movably installed at the housing via a rotary shaft and having multiple buttons thereon; and a position adjustment unit to move the operation panel at a predetermined angle with respect to the housing and to maintain the operation panel at the predetermined angle, wherein the position adjustment unit comprises:

an angle adjusting plate installed at the rotary shaft and having teeth, a bracket rotatably installed at the housing, a swing gear rotatably installed at the bracket and having an operation lever thereon, and an interlocking gear rotatably installed at the bracket to interlock the swing gear and the angle adjusting plate.

2. The image forming apparatus of claim 1, wherein the position adjustment unit further comprises an elastic part to elastically bias the bracket away from the angle adjusting plate.

3. An image forming apparatus, comprising:

a housing;

an operation panel movably installed at the housing via a shaft and having multiple buttons thereon; and a position adjustment unit to move the operation panel at a predetermined angle with respect to the housing and to maintain the operation panel at the predetermined angle wherein the position adjustment unit comprises:

an angle adjusting plate installed at the rotary shaft and having teeth on an outer periphery thereof, and an operator rotatably installed at the housing and comprising a lever at an end thereof and a fixing portion at another end thereof, the fixing portion being engagable with the teeth of the angle adjusting plate by an operation of the lever so that the angle adjusting plate cannot be rotated.

4. The image forming apparatus of claim 3, wherein the fixing portion of the operator is elastically biased toward the angle adjusting plate by a spring.

5. An image forming apparatus, comprising:

a housing;

an operation panel movably installed at the housing via a rotary shaft and having multiple buttons thereon; and a position adjustment unit to move the operation panel at a predetermined angle with respect to the housing and to maintain the operation panel at the predetermined angle, wherein the position adjustment unit comprises:

a first coupling member slidingly installed in an axis direction of the rotary shaft and having first coupling teeth, a second coupling member fixed at the housing and having second coupling teeth that engage with the first coupling teeth, and a release member to slidingly pass through the second coupling member to separate the second coupling member from the first coupling member.

6. The image forming apparatus of claim 5, wherein the first coupling member is elastically biased toward the second coupling member by an elastic part.

7. The image forming apparatus of claim 5, wherein the release member comprises:

a support member fixed at the housing; and a release shaft slidingly supported by the support member and the second coupling member and having an operation button at an end thereof.

8. An image forming apparatus, comprising:

a housing;

a rotary shaft installed at the housing to rotate with respect to the housing;

an operation panel installed at the rotary shaft to rotate with the rotary shaft; and a control unit to control the rotation of the rotary shaft, wherein:

the rotary shaft comprises teeth to interlock with the control unit and the control unit comprises:

one or more gears to interlock with the teeth of the rotary shaft to control the rotation of the rotary shaft, and a control lever to rotate the one or more gears.

9. The image forming apparatus of claim 8, wherein the one or more gears of the control unit are elastically biased away from the teeth of the rotary shaft.

10. The image forming apparatus of claim 9, wherein the rotary shaft does not rate when the one more gears of the control unit do not interlock with the teeth of the rotary shaft.

11. An image forming apparatus, comprising:

a housing;

rotary shaft installed at the housing to rotate with respect to the housing;

an operation panel installed at the rotary shaft to rotate with the rotary shaft; and a control unit to control the rotation of the rotary shaft, wherein:

the rotary shaft comprises teeth to interlock with the control unit, and the control unit comprises:

a fixing portion to engage the teeth of the rotary shaft to prevent the rotary shaft from rotating, and a control lever to separate the fixing portion from the teeth of the rotary shaft to allow the rotary shaft to rotate.

12. The image forming apparatus of claim 11, wherein the fixing portion of the control unit is elastically biased to engage the teeth of the rotary shaft.

13. An image forming apparatus, comprising:

a housing:

rotary shaft installed at the housing to rotate with respect to the housing;

an operation panel installed at the rotary shaft to rotate with the rotary shaft; and a control unit to control the rotation of the rotary shaft, wherein the control unit comprises:

a locking unit disposed at the rotary shaft to prevent the rotary shaft from rotating, and a release unit to disengage the locking unit to allow the rotary shaft to rotate.

14. The image forming apparatus of claim 13, wherein the locking unit comprises a first coupling member slidably provided on the rotary shaft, and a second coupling member fixedly provided at the housing to couple with the first coupling member to prevent the rotary shaft from rotating.

15. The image forming apparatus of claim 14, wherein the release unit comprises a shaft to pass through the second coupling member to contact the first coupling member and separate the first coupling member from the second coupling member.

16. The image forming apparatus of claim 15, wherein the first coupling member is elastically biased towards the second coupling member.

17. An image forming apparatus, comprising:

a printing unit;

a main body;

an adjustable operation panel provided at an upper side of the main body and adjustable at different angles with respect to the main body by rotating with respect to the main body; and a locking unit to lock the adjustable operation panel at a desired angle with respect to the main body.

18. The image forming apparatus of claim 17, wherein the locking unit comprises a locking member to prevent the adjustable operation panel from rotating with respect to the housing, and a release member to release the locking member to allow the adjustable operation panel to rotate with respect to the housing.

19. The image forming apparatus of claim 17, further comprising:

an adjusting member to apply a rotational force to the adjustable operation panel when in contact with the adjustable operation panel;

a elastic member connected at one end to the housing and at another end to the adjustment member to elastically bias the adjustment member away from the adjustable operating panel; and a control member to control the adjusting member to contact the adjustable operation panel, and to control the rotational force of the adjusting member.

20. The image forming apparatus of claim 19, wherein the adjustable operation panel does not rotate when the adjusting member is not in contact with the adjustable operation panel.

21. The image forming apparatus of claim 17, wherein the adjustable operation panel comprises a display window.

22. An image forming apparatus, comprising:

a main body;

an operation panel extending from the main body to program operations of the image forming device; and a position adjustment unit to adjust positions of the operation panel with respect to the main body, wherein the position adjustment unit comprises:

a rotary shaft extending through a portion of the main body, being connected to end portions of the operation panel and having gears at one end thereof, and a lever assembly including a first portion engageable with the gears of the rotary shaft and an adjustable lever to engage and disengage the first portion to and from the gears to control a rotation of the operation panel at different angles with respect to the main body.

23. The image forming apparatus of claim 22, wherein when the lever is moved, the first portion engages with the gears to move the rotary shaft and the operation panel.

24. The image forming apparatus of claim 23, wherein the first portion includes a swing gear and an interlocking gear.

25. The image forming apparatus of claim 22, wherein when the lever is moved, the first portion engages with the gears to prevent movement of the rotating shaft and the operation panel.

26. The image forming apparatus of claim 25, wherein when the first portion includes a fixing lever.

27. An image forming apparatus, comprising:

a main body;

an operation panel extending from the main body to program operations of the image forming device; and a position adjustment unit to adjust positions of the operation panel with respect to the main body, wherein the position adjustment unit comprises:

a first portion including a rotary shaft extending through a portion of the main body, being connected to end portions of the operation panel and having a first coupling member extending from one end thereof, and a second portion including a release shaft having a button at a first end thereof and a second coupling member at which a second end of the release shaft extends therethrough, such that when the button is pressed, the release shaft extends through the second coupling member and separates the first coupling member from the second coupling member to allow rotation of the rotary shaft and the operation panel with respect to the main body.

28. The image forming apparatus of claim 27, the position adjustment unit further comprises:

an elastic member to bias the first coupling member toward the second coupling member when the button is not pressed.

29. An image forming apparatus, comprising:

a printing unit;

a main body;

an adjustable operation panel provided at an upper side of the main body by rotating with respect to the main body; and a locking unit to lock the adjustable operation panel at a desired angle with respect to the main body, wherein a member of the locking unit comprises a hinge disposed between one end and another end.

30. The image forming apparatus of claim 29, wherein the hinge is disposed at one of the adjustable operation panel and the main body.

* * * * *

UNITED STATES PATENT AND TRADEMARK OFFICE

CERTIFICATE OF CORRECTION

PATENT NO. : 7,298,986 B2
APPLICATION NO. : 11/102822
DATED : November 20, 2007
INVENTOR(S) : Ho-il Lee It is certified that error appears in the above-identified patent and that said Letters Patent is hereby corrected as shown below:

In claim 18 at column 7, lines 26 and 28, “housing” should be changed to -- main body --.
In claim 19 at column 7, lines 34, “housing” should be changed to -- main body --.

Signed and Sealed this

Sixteenth Day of June, 2009

JOHN DOLL
*Acting Director of the United States Patent and Trademark Office*